US005203240A

United States Patent [19]

Sorter

[11] Patent Number: 5,203,240

[45] Date of Patent: Apr. 20, 1993

[54] CASTELLATED VALVE WRENCH

[76] Inventor: James L. Sorter, 9760 Lime Lake Rd., Hudson, Mich. 49247

[21] Appl. No.: 626,396

[22] Filed: Dec. 11, 1990

Related U.S. Application Data

[63] Continuation of Ser. No. 478,554, Feb. 12, 1990, abandoned.

[51] Int. Cl.[5] ..... B25B 13/46

[52] U.S. Cl. ..... 81/63.2; 81/124.2; 81/176.15

[58] Field of Search ..... 81/63.2, 124.2, 124.3, 81/176.1, 176.15, 176.2

[56] References Cited

U.S. PATENT DOCUMENTS

| | | | |
|---|---|---|---|
| 2,004,639 | 6/1935 | Thewes | 81/63.2 X |
| 2,619,861 | 12/1952 | Wanamaker | 81/176.15 |
| 3,010,346 | 11/1961 | Kulp | 81/124.2 |
| 3,274,864 | 9/1966 | Chapman | 81/124.2 X |
| 4,817,475 | 4/1989 | Kelly et al. | 81/124.3 X |

*Primary Examiner*—James G. Smith

*Attorney, Agent, or Firm*—Willian Brinks Olds Hofer Gilson & Lione

[57] ABSTRACT

An apparatus for engaging and rotating large and/or difficult to turn handwheels of valves includes a castellated drive member and separable ratchet drive assembly. The drive member includes a plurality of T-shaped slots which receive and retain the spokes of a valve wheel. The drive member also includes a multi-sided stub defining a through, axial passageway. The stub is removably received within a complementarily configured passageway in a collar of the ratchet drive assembly. The collar, in turn, is received within a housing and is acted upon by a pawl. An elongate handle extends radially from the housing and facilitates the application of significant torque to the apparatus and an associated valve handwheel.

16 Claims, 3 Drawing Sheets

FIG. 1
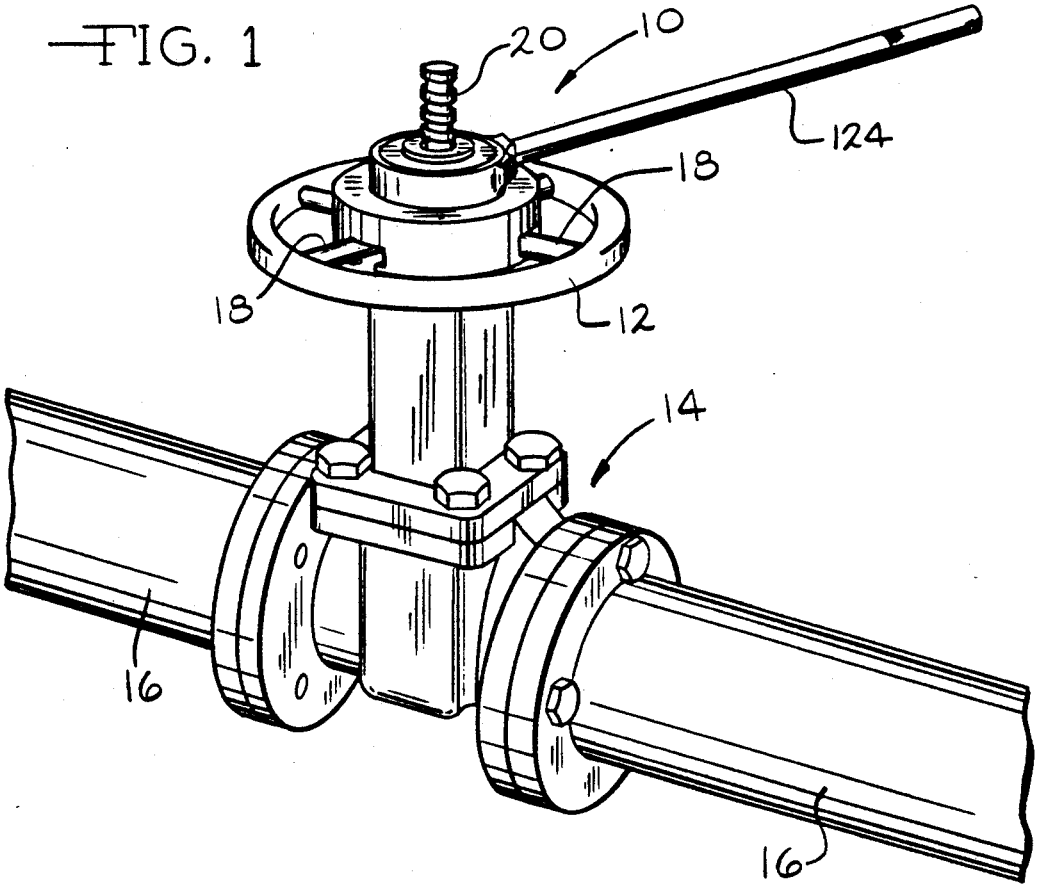
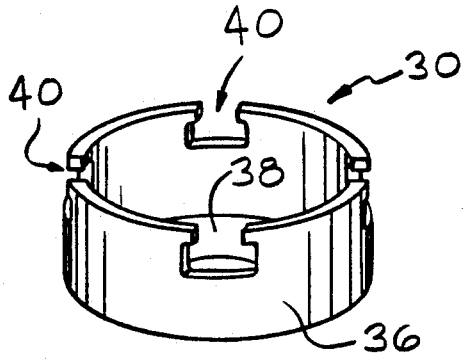
FIG. 2
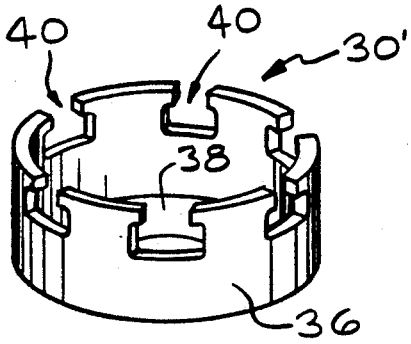
FIG. 3

CASTELLATED VALVE WRENCH

CROSS REFERENCE TO COPENDING APPLICATION

This application is a continuation of Ser. No. 07/478,554, filed Feb. 13, 1990, now abandoned.

BACKGROUND OF THE INVENTION

The invention relates to an apparatus for applying torque to valve handwheels and the like and more specifically to such an apparatus having a circular drive member with a plurality of T-shaped slots and a separable drive assembly including a reversible ratchet mechanism and elongate handle.

In refineries, petrochemical plants, water treatment plants and other facilities where large liquid and gas flows are common, significant numbers of large valves are equally common. Typically, such valves are operated by handwheels having diameters of from several inches to a few feet. Although handwheel sizes relate generally to the size of the valve and the torque necessary to open and close it, the actual torque necessary to open and close a valve either as it ages or is only occasionally operated, can increase dramatically over the initial operating torque. In many instances, the operating torque of an aging or seldom used valve may be great enough to present the potential for human injury or it may simply render it inoperable.

This problem has been addressed in the prior art. For example, U.S. Pat. No. 1,460,922 discloses a valve actuating means comprising a radially extending handle which is disposed about the valve stem and includes projections which engage the valve handwheel or its spokes.

A similar construction is illustrated in U.S. Pat. No. 2,920,517 wherein an elongate handle is received on the stem of the valve and a pair of spaced apart projections straddle a valve spoke and engage the handwheel.

U.S. Pat. Nos. 2,086,722 and 2,539,262 disclose valve turning tools which both engage only the outer wheel portion of the handwheel at two spaced apart locations.

U.S. Pat. Nos. 2,682,189 and 4,715,252 both disclose wrench like valve tools which engage the handwheel at one location. While these tools as well as several of the foregoing facilitate the application of increased torque to the valve handwheel, they have in common a significant disadvantage. Because they apply unbalanced force to the handwheel at a single location, a static bending moment is created. Such unbalanced force application is less efficient than balanced, i.e., on center, torque application and can also damage the valve.

Study of the foregoing patented devices reveals another difficulty. Many of the foregoing devices may slip upon the valve handwheel when torque is applied. Clearly an abrupt, spontaneous repositioning of the device on the handwheel is undesirable. Furthermore, many of these designs are not self retaining and will disconnect and fall from the valve handwheel if not held in position by an operator. Finally, many of the foregoing devices are suitable for only a specific size or limited range of sizes of valve handwheels.

The foregoing suggests that improvements to devices for applying torque to valve handwheels are both desirable and possible.

SUMMARY OF THE INVENTION

An apparatus for engaging and rotating large and/or difficult to turn handwheels of valves includes a castellated drive member and separable ratchet drive assembly. The drive member is in the form of an annulus and includes a plurality of T-shaped slots having narrow throat regions and wider re-entrant regions which receive and retain the spokes of a valve wheel. The drive member also includes a multi-sided drive stub or stanchion defining a through, axial passageway. The drive stub is removably received within a complementally configured passageway in a collar of the ratchet drive assembly. The collar is received within a housing and is acted upon by a ratchet pawl. An elongate handle extends radially from the housing and facilitates the application of significant torque to the apparatus and a valve handwheel. The ratchet drive is reversible so that torque may be applied in both directions and valves may be opened or closed. The apparatus comprehends a plurality of drive members having various arrangements of slots to match and engage a plurality of complementally configured handwheels.

Accordingly, it is an object of the present invention to provide an apparatus for applying torque to valve handwheels.

It is a further object of the present invention to provide an apparatus for applying torque to valve handwheels uniformly in a manner that bending moments are neither generated nor applied to the valve stem and other valve components.

It is a still further object of the present invention to provide an apparatus for applying torque to valve handwheels having a plurality of castellated drive annuli having various arrangements of T-shaped slots for receiving corresponding various configurations of valve handwheel spokes.

It is a still further object of the present invention to provide an apparatus for applying torque to valve handwheels having a reversible ratchet assembly.

Further objects and advantages of the present invention will become apparent by reference to the following description of the preferred embodiment and appended drawings.

BRIEF DESCRIPTION OF THE DRAWINGS

FIG. 1 is a perspective view of an apparatus according to the present invention in place upon a valve handwheel;

FIG. 2 is a perspective view of a castellated drive annulus having four slots for use with a handwheel having two or four spokes;

FIG. 3 is a perspective view of a castellated drive annulus having six slots for use with a handwheel having three or six spokes;

DESCRIPTION OF THE PREFERRED EMBODIMENT

Figure 4:
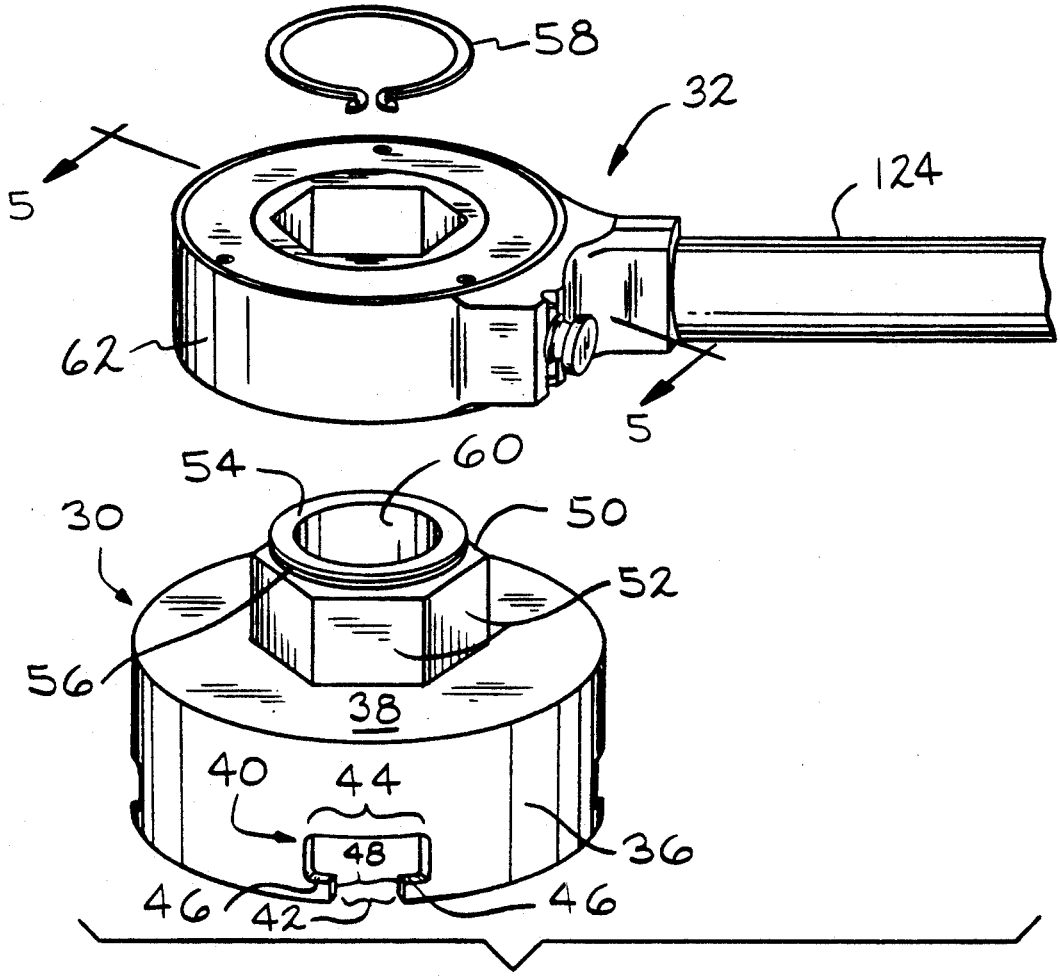
FIG. 4 is a fragmentary, exploded perspective view of a valve handwheel rotating apparatus according to the present invention.
Figure 5:
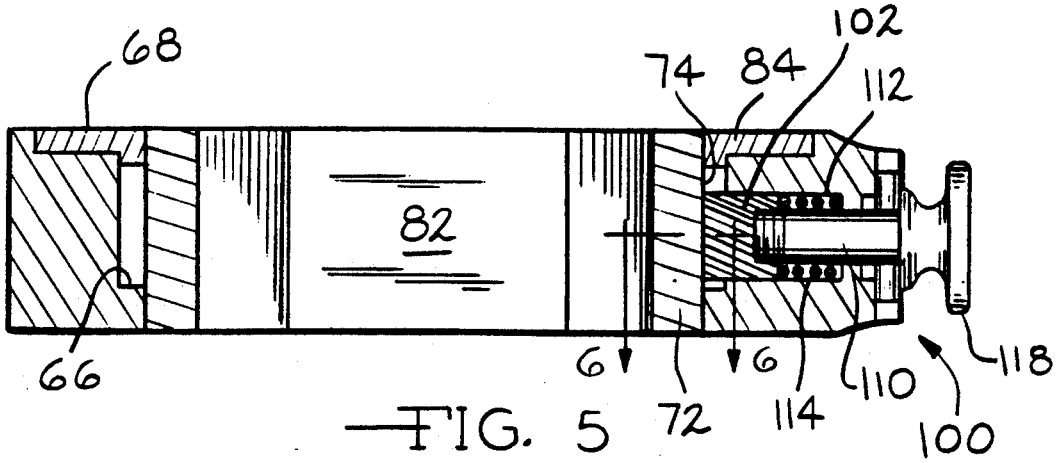
FIG. 5 is a full sectional view of the ratchet drive assembly according to the present invention taken along line 5—5 of FIG. 4.

Referring now to FIG. 1, a castellated valve wrench is illustrated and generally designated by the reference numeral 10. The valve wrench 10 is positioned upon a handwheel 12 of a valve 14. Neither the handwheel 12 nor the valve 14 constitute a portion of the present invention. Typically, the valve 14 is sealingly disposed between and secured to sections of a fluid pipeline 16. A plurality of spokes 18 extend radially inwardly from the handwheel 12 and join at a threaded hub (not illustrated). The number of spokes 18 may vary. In certain handwheel 12 assemblies, there may be as few as two spokes 18, or there may be three spokes, four spokes, five spokes, six spokes or more. Generally speaking, the larger the diameter of the handwheel 12 and the larger the size of the valve 14, the greater will be the number of spokes 18.

In most valve configurations, the valve 14 will include a valve stem 20 extending upwardly from the body of the valve 14. As the valve opens, the valve stem 20 will rise and as the valve closes, the valve stem 20 will descend. It will be appreciated, however, that valve configurations exist in which the valve stem 20 does not extend above the handwheel 12 or in which other action of the valve stem 20 occurs. The castellated valve wrench 10 of the present invention functions equally well with valves which include the valve stem 20, with those which do not and those which function in various manners.

Referring now to FIGS. 2 and 4, the castellated valve wrench assembly 10 includes an annular drive socket assembly 30 and a ratchet drive assembly 32. Turning first to the annular socket assembly 30, the socket assembly 30 includes an cylindrical sidewall 36 and a circular disc 38. At a plurality of equally circumferentially spaced locations in the cylindrical sidewall 36 are disposed T-shaped slots 40. The slots 40 define a narrow, spoke receiving throat region 42 and a wider spoke retaining rectangular region 44. The axial depth of the rectangular region 44 is preferably about equal to or greater than the diameter of a typical valve spoke 18. Preferably, the rectangular region 44 is circumferentially centered with the throat region 42, that is, the ledges 46 are of equal circumferential length. The ledges 46 in each slot 40 define a pair of opposed teeth 48 which assist retention of the spokes 18 of the handwheel 12 within the slots 40 of the socket assembly 30. The socket assembly 30 illustrated in FIG. 4 includes four T-slots 40 equally spaced at 90 degree intervals about the cylindrical sidewall 36. Such a socket assembly 30 will function with a valve handwheel 12 having either two or four spokes 18.

It is anticipated that in order to make the apparatus 10 fully adaptable to all valves 14 and specifically various patterns of spokes 18, a small number, typically two, three or four socket assemblies 30 will be interchangeably available for use with a single ratchet drive assembly 32. For example, in FIG. 3, an alternate embodiment socket assembly 30′ is illustrated which includes six T-shaped slots 40. The six T-shaped slots 40 are in all respects identical to the slots 40 illustrated in FIGS. 2 and 4. The six T-shaped slots 40 are arranged at equal 60° intervals about the cylindrical sidewall 36. It will be appreciated that the socket assembly 30′ is adapted for use with a handwheel 12 having either two, three or six equally spaced spokes 18. It should thus be understood that various and additional socket assemblies 30 defining, for example, five T-shaped slots 40 or any other convenient or necessary number of T-shaped slots 40 required to engage particular handwheel/spoke configurations is wholly within the purview of the present invention.

Turning again to FIG. 4, the socket assembly 30 also includes a drive stub or stanchion 50 having a plurality of axially extending flats 52. The flats 52 are preferably six in number and disposed in opposed parallel pairs to form a hexagonal outer surface on the drive stanchion 50. However, more or fewer flats 52 may be utilized as well as other axially separable couplings such as splines or radially oriented, spring biased locking pins. The drive stanchion 50 terminates in a narrow annulus 54 having a circumferential groove 56 formed in its peripheral surface. The circumferential groove 56 receives a snap ring or C-washer 58 or similar structure which selectively retains the socket assembly 30 in the ratchet drive assembly 32 as illustrated in FIG. 1. The drive stanchion 50 is hollow and defines a through, preferably circular aperture 60.

Turning now to FIGS. 4, 5, 6 and 7, the ratchet drive assembly 32 includes a generally circular housing or head 62 defining a multiply stepped or shouldered circular aperture 64. The circular aperture 64 includes a first shoulder region 66 spaced a short axial distance from one face of the circular head 62 and a second, larger diameter shoulder region 68 spaced a short axial distance from the other face of the circular head 62. Disposed and retained within the aperture 64 is a ratchet collar 72. The ratchet collar 72 is circular and disc-like in construction and includes a plurality of axially oriented splines or teeth 74 about its periphery. Each of the teeth 74 include opposed flats 76. The flats 76 are coincident with radially extending planes passing through the center axis of the collar 72. The teeth 74 are medially disposed about the periphery of the collar 72 and accordingly define spaced apart, reduced diameter bearing regions 78. The ratchet collar 72 also includes a through, centrally disposed aperture 80 defining a plurality of flats or sidewalls 82. The configuration of the aperture 80 is complementarily to and drivingly receives the drive stanchion 50. Preferably, therefore, the flats 82 are six in number and arranged in a hexagonal pattern. Other configurations which complementally receive the particular configuration of the drive stanchion 50 such as four sided, eight sided or twelve sided or diverse axially movable and rotationally engageable components such as splines or radial pins may be utilized if desired and are within the purview of the present invention.

The ratchet collar 72 is received within the circular head 62 and specifically the aperture 64. The ratchet collar 72 is retained therein by a circular plate 84. The circular plate 84 defines a large centrally disposed aperture 86 which receives one of the reduced diameter bearing regions 78 of the ratchet collar 72. The circular plate 84 defines a plurality of smaller through apertures 88 which receive threaded fasteners 90. The threaded fasteners 90 extend through the apertures 88 and into complementally threaded and arranged blind openings 92 in the circular head 62.

The ratchet drive assembly 32 also includes a pawl assembly 100. The pawl assembly 100 includes a pawl 102 which defines an obliquely oriented ramp surface 104 and a flat, radially oriented surface 106. The ramp surface 104 slidingly engages the teeth 74 of the ratchet collar 72 and permits rotation of the collar 72 in a direction generally toward the ramp surface 104 whereas the radial surface 106 engages the opposed flats 76 of the teeth 74 and inhibits rotation in a direction generally toward the radial surface 106. The pawl 102 is securely fastened by complementary male and female threads or other appropriate fastening means to a pawl pin 110. The pawl 102 and the pawl pin 110 are received within a suitably sized aperture 112 extending radially outwardly from the circular aperture 64. Disposed concentrically about the pawl pin 110 is a compression spring 114 which biases the pawl 102 and the pawl pin 110 toward the ratchet collar 72. A register pin 116 extends radially through the pawl pin 110 and is disposed in parallel with the ramp surface 104 and the radial surface 106. The register pin 116 is selectively received within and released from a complementally configured groove 117 formed in the circular head 62 which radially intersects the aperture 112. At the terminus of the pawl pin 110 is a readily grippable button or knob 118.

Figures 6, 7:
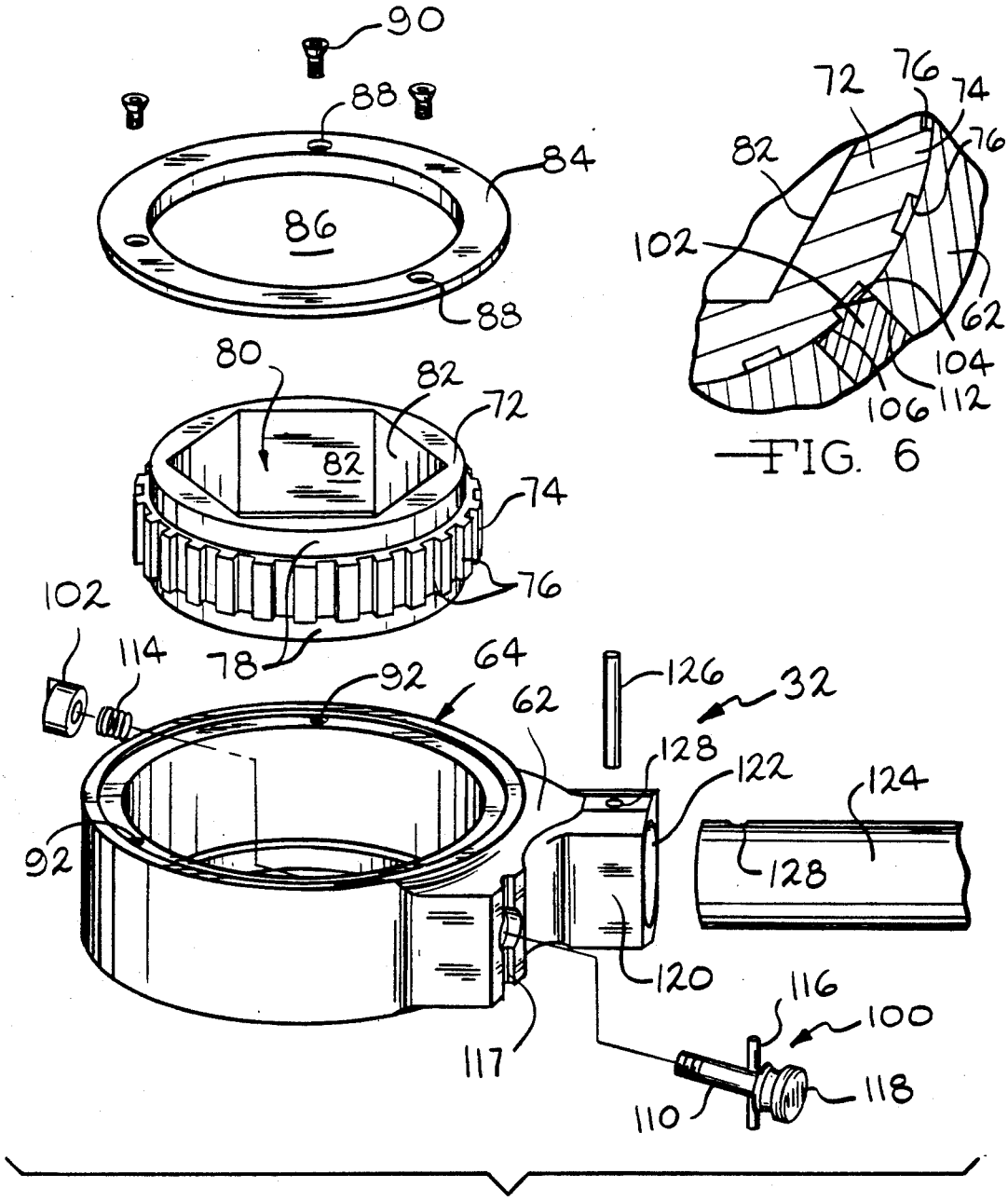
FIG. 6 is a fragmentary sectional view of a pawl assembly according to the present invention taken along the line 6—6 of FIG. 5.
FIG. 7 is an exploded, fragmentary perspective view of a ratchet drive assembly according to the present invention.

The ratchet assembly 100 not only provides conventional ratchet action, that is, bi-directional motion of the drive assembly and unidirectional motion of the driven assembly, but also permits selection of the direction of rotation of the driven assembly. This is accomplished by withdrawing the pawl pin 110 against the bias of the compression spring 114 by pulling on the knob 118. When the register pin 116 has cleared the groove 117, the pawl assembly 100 may be rotated 180 degrees to select the opposite ratchet and drive action. That is, in one position the ratchet is as illustrated in FIG. 6 and provides clockwise drive to the ratchet collar 72 and associated components and, when the pawl pin 110 and specifically the pawl 102 is in the position 180 degrees opposed from that illustrated in FIG. 6, the pawl assembly 100 will, upon suitable external activation, cause the ratchet collar 72 to rotate in the counterclockwise direction.

Finally, the circular head 62 includes a radially extending member 120 defining a blind aperture 122 which receives an elongate rigid tube or bar 124. The bar 124 which functions as a torque applying handle may be removably secured to the circular head 62 by a retaining pin 126 which passes through complementally sized and aligned openings 128 in the member 120 and the elongate bar 124.

The operation of the valve wrench 10 is straightforward. The primary preparatory step to utilizing the valve wrench 10 is the selection of a suitable annular drive socket 30. As illustrated in FIGS. 2 and 3, the socket 30 and the socket 30' may include four or six slots 40, respectively, adapting the sockets 30 and 30' for use with handwheels having two or four spokes 18 or three or six spokes 18, respectively, as will be readily appreciated. As noted previously, the invention comprehends the use of other socket 30 having other numbers and patterns of T-shaped slots 40 as required to match and engage various valve handwheels 12. When selected, the socket 30 is aligned with the ratchet drive assembly 32 generally as illustrated in FIG. 4, the ratchet drive assembly 32 is positioned on the drive stanchion 50 and the C-washer 58 is seated in the circumferential groove 56 to maintain the components in an assembled configuration.

Next, the valve wrench 10 is positioned upon the handwheel 12 and specifically the spokes 18 of the valve 14 which is to be opened or closed. The pawl assembly 100 is then adjusted to provide the proper direction of drive at the socket assembly 30 and ratchet action of the bar 124. With the spokes 18 seated within the T-shaped slots 40, that is, adjacent the ledges 46 of the slots 40 and not within throat region 42, torque is applied through the bar 124 in the appropriate direction to open or close the valve 14. It will be appreciated that the circular aperture 60 in the drive stanchion 50 receives the valve stem 20 if and when it extends upwardly from the valve 14.

The components of the valve wrench 10 may be fabricated of standard and conventional material such as 1045 steel and the like. The components likewise may be formed and assembled by conventional means such as stamping, forging, casting and welding.

The foregoing disclosure is the best mode devised by the inventor for practicing this invention. It is apparent, however, that apparatus incorporating modifications and variations will be obvious to one skilled in the art of torque augmenting tools. Inasmuch as the foregoing disclosure is intended to enable one skilled in the pertinent art to practice the instant invention, it should not be construed to be limited thereby but should be construed to include such aforementioned obvious variations and be limited only by the spirit and scope of the following claims.

I claim:

1. A torque applying apparatus for handwheels comprising, in combination, a drive member having an open face and a sidewall defining an interior for receiving a portion of a handwheel and a plurality of slots opening in the direction of said face, said slots having a narrow throat region defined by a pair of opposed projections communicating with an enlarged region adjacent said projections, a stanchion extending from said drive member along an axis, said stanchion including engageable means for receiving rotational force, and an aperture for receiving a valve stem extending along said axis and through said stanchion, a ratchet drive means for selectively, bi-directionally rotating said drive member, said ratchet drive means including a drive collar having complementary means for engaging said engageable means of said drive member and ratchet teeth disposed about its periphery, a ratchet member engaging said ratchet teeth of said drive collar and a housing for receiving said collar and said ratchet member and an elongate member extending from said housing and means for retaining said stanchion of said drive member in said ratchet drive means.

2. The torque applying apparatus of claim 1 wherein said retaining means includes a circumferential groove in said stanchion and further including a split retaining washer seated within the said groove to maintain said drive member coupled to said ratchet drive means.

3. The torque applying apparatus of claim 1 further including a pin coupled to said ratchet member, said pin defining a line of action of said ratchet member, a spring for biasing said ratchet member along said line of action, a register pin disposed perpendicularly to said line of action and extending through said pin and at least one groove defined by said housing and extending radially from said line of action for receiving said register pin.

4. The torque applying apparatus of claim 1 wherein said drive member includes at least two slots.

5. The torque applying apparatus of claim 1 wherein said drive member includes at least three slots.

6. The torque applying apparatus of claim 1 wherein said sidewall is circular and said engaging means and said engageable means are hexagonal.

7. The torque augmenting apparatus of claim 1 wherein said collar includes reduced diameter regions on each side of said teeth.

8. A torque applying apparatus for applying torque to the spokes of a rotatable wheel comprising, in combination, a drive member having a sidewall defining an open end, an interior adapted to receive a portion of said wheel and a plurality of spoke receiving slots extending away from said open end, said sidewall including a pair of circumferentially extending opposed projection in said slots defining a throat between said open end and an enlarged spoke receiving recess, a drive stub extending from said drive member along an axis, said drive stub including means engageable by means for transmitting rotational force to said drive stub and an aperture adapted for receiving a valve stem, said aperture communicating with said interior and extending through said drive stub along said axis, a ratchet drive means for bi-directionally rotating said drive member, said ratchet drive means including a housing, a drive collar including complementary means for engaging said engageable means of said drive member and ratchet teeth disposed about its periphery, and an elongate handle extending from said housing and means for retaining said stub of said drive member in said ratchet drive means.

9. The torque applying apparatus of claim 8 wherein said ratchet drive means includes a spring biased pawl engaging said ratchet teeth.

10. The torque applying apparatus of claim 8 wherein said drive member includes at least two slots.

11. The torque applying apparatus of claim 8 wherein said drive member includes at least three slots.

12. The torque applying apparatus of claim 8 wherein said engaging means and said engageable means are hexagonally disposed flats.

13. A castellated valve wrench for applying torque to the spokes of a rotatable handwheel of a valve comprising, in combination, a drive member having an open face and a circular sidewall defining an interior for receiving a portion of said handwheel and a plurality of slots opening in the direction of said open face, said slots having a narrow throat region defined by a pair of opposed projections and a wider region extending in both circumferential directions from said throat, a stanchion extending from said drive member along an axis, said stanchion including engageable means for receiving rotational force, and an aperture for receiving a valve stem, said aperture extending along said axis, communicating with said interior and extending through said stanchion, a ratchet drive means for selectively, bi-directionally rotating said drive member, said ratchet drive means including a drive collar including complementary means for engaging said engageable means of said drive member, a ratchet pawl engaging said drive collar, a housing for receiving said collar and said ratchet pawl, said housing including a socket and an elongate member extending from said socket of said housing, and means for selectively coupling said drive member and said ratchet drive means.

14. The apparatus of claim 13 wherein said selectively coupling means includes a circumferential groove in said stanchion and a split retaining washer disposed in said groove.

15. The apparatus of claim 13 wherein said drive collar includes a plurality of ratchet teeth disposed about its periphery between a pair of reduced diameter bearing regions.

16. The apparatus of claim 13 wherein said engaging means and said engageable means are complemental hexagonally disposed flats.

* * * * *